US009527656B2

(12) United States Patent
Walters et al.

(10) Patent No.: US 9,527,656 B2
(45) Date of Patent: Dec. 27, 2016

(54) TOUCHLESS DISPENSER

(75) Inventors: Peter J. Walters, Barrington, IL (US); Craig A. Braun, Elgin, IL (US); Jörg Kohlne, VS-Schwenningen (DE); Volker Umbeer, Radolfzell (DE)

(73) Assignee: Seaquistperfect Dispensing L.L.C., Cary, IL (US)

( * ) Notice: Subject to any disclaimer, the term of this patent is extended or adjusted under 35 U.S.C. 154(b) by 2012 days.

(21) Appl. No.: 12/462,296

(22) Filed: Jul. 31, 2009

(65) Prior Publication Data

US 2011/0024449 A1 Feb. 3, 2011

(51) Int. Cl.

| | |
|---|---|
| ***B67D 1/00*** | (2006.01) |
| ***B65D 83/20*** | (2006.01) |
| *B05B 11/00* | (2006.01) |
| *B65D 83/62* | (2006.01) |

(52) U.S. Cl.

CPC ..... *B65D 83/205* (2013.01); *B05B 11/3052* (2013.01); *B65D 83/62* (2013.01)

(58) Field of Classification Search

CPC ..... G05B 19/042; G05B 15/02; H05B 6/6435; B05C 17/0103; B05C 5/0225; A01C 7/04; A01C 7/12; A47K 5/1217; A47K 5/10; B67D 1/1247; B67D 3/0039; G01F 13/006; G07D 11/0003; A61J 7/0084; B60S 1/483; B65D 23/003; B65D 47/286; B65D 83/205; B65D 83/26; B65D 83/262

USPC ..... 222/52, 63, 64, 181.3, 181.1, 181.2, 639,222/642, 333, 504, 225, 274, 559; 4/623; 221/12, 13; 700/14, 15, 19

See application file for complete search history.

(56) References Cited

U.S. PATENT DOCUMENTS

| | | | | |
|---|---|---|---|---|
| 3,187,949 | A * | 6/1965 | Mangel | B65D 83/262 222/394 |
| 3,419,188 | A * | 12/1968 | Matchett | 222/52 |
| 3,848,775 | A * | 11/1974 | Possell | 222/649 |
| 3,974,941 | A * | 8/1976 | Mettler | B65D 83/262 222/504 |
| 4,722,372 | A * | 2/1988 | Hoffman et al. | 141/98 |
| 4,946,070 | A * | 8/1990 | Albert et al. | 222/52 |

(Continued)

FOREIGN PATENT DOCUMENTS

| | | |
|---|---|---|
| WO | WO 00/75046 | 12/2000 |
| WO | WO 03/005873 | 1/2003 |
| WO | WO 2005/112724 | 12/2005 |

OTHER PUBLICATIONS

International Search Report and Written Opinion from PCT/US2010/02075, Jul. 9, 2010.

*Primary Examiner* — Patrick M Buechner
(74) *Attorney, Agent, or Firm* — Wood, Phillips, Katz, Clark & Mortimer

(57) ABSTRACT

A touchless dispenser is provided for a pressurized container including a valve member. The dispenser comprises a housing mountable to the container. An electrically controlled valve in the housing includes an inlet and an outlet. The inlet maintains the valve member in an open position incident to the housing being mounted on the container. A nozzle extends between the valve outlet and a discharge orifice. A sensor senses a user's hand proximate the discharge orifice. A control in the housing is operatively coupled to the sensor and the electrically controlled valve. The control controls operation of the electrically controlled valve to dispense a select dosage of product from the container responsive to the sensor sensing presence of a user's hand proximate the discharge orifice.

7 Claims, 7 Drawing Sheets

(56) References Cited

U.S. PATENT DOCUMENTS

| | | | | |
|---|---|---|---|---|
| 4,967,935 | A * | 11/1990 | Celest | 222/52 |
| 5,397,028 | A | 3/1995 | Jesadanont | |
| 5,836,482 | A * | 11/1998 | Ophardt et al. | 222/325 |
| 6,036,056 | A * | 3/2000 | Lee et al. | 222/63 |
| 6,209,751 | B1 * | 4/2001 | Goodin et al. | 222/52 |
| 6,209,752 | B1 * | 4/2001 | Mitchell et al. | 222/63 |
| 6,216,925 | B1 * | 4/2001 | Garon | B65D 83/205 222/645 |
| 6,279,777 | B1 * | 8/2001 | Goodin et al. | 222/52 |
| 6,390,329 | B1 * | 5/2002 | Maddox | 222/25 |
| 6,412,679 | B2 * | 7/2002 | Formon et al. | 225/14 |
| 6,413,238 | B1 | 7/2002 | Maget | |
| 6,607,103 | B2 * | 8/2003 | Gerenraich et al. | 222/183 |
| 6,651,851 | B2 * | 11/2003 | Muderlak et al. | 222/333 |
| 7,040,566 | B1 * | 5/2006 | Rodrian et al. | 242/563 |
| 7,044,421 | B1 * | 5/2006 | Omdoll et al. | 242/564.4 |
| 7,084,592 | B2 * | 8/2006 | Rodrian | 318/272 |
| 7,527,178 | B2 * | 5/2009 | Lewis | 222/333 |
| 7,611,030 | B2 * | 11/2009 | Reynolds et al. | 222/1 |
| 7,909,209 | B2 * | 3/2011 | Reynolds et al. | 222/41 |
| 8,109,411 | B2 * | 2/2012 | Yang et al. | 222/52 |
| 2004/0251271 | A1 * | 12/2004 | Jackson et al. | 222/63 |
| 2005/0171634 | A1 * | 8/2005 | York et al. | 700/231 |
| 2005/0247735 | A1 * | 11/2005 | Muderlak et al. | 222/190 |
| 2006/0131350 | A1 * | 6/2006 | Schechter et al. | 222/645 |
| 2006/0153733 | A1 | 7/2006 | Sassoon | |
| 2008/0099483 | A1 | 5/2008 | Anderson et al. | |
| 2008/0156896 | A1 | 7/2008 | Anderson et al. | |
| 2008/0272208 | A1 | 11/2008 | Anderson et al. | |
| 2008/0277411 | A1 * | 11/2008 | Beland et al. | 222/52 |
| 2008/0277501 | A1 | 11/2008 | Everett et al. | |
| 2008/0290113 | A1 * | 11/2008 | Helf et al. | 222/52 |
| 2009/0045218 | A1 * | 2/2009 | Helf et al. | 222/52 |
| 2009/0045219 | A1 * | 2/2009 | Helf et al. | 222/52 |
| 2009/0045220 | A1 * | 2/2009 | Helf et al. | 222/52 |

* cited by examiner

TOUCHLESS DISPENSER

TECHNICAL FIELD

The present invention relates generally to a dispensing system for a fluent product, which can include liquids, gases, foams, dispersions, pastes, creams, etc. The invention more particularly relates to a touchless dispenser used with a pressurized container, including an aerosol container, to administer uniform doses and adapted to be readily assembled.

BACKGROUND OF THE INVENTION AND TECHNICAL PROBLEMS POSED BY THE PRIOR ART

Finger-operable dispensers are typically adapted to be incorporated in dispensing systems mounted on hand-held containers that are commonly used for fluent products. Some dispensing systems incorporate a pump and the user depresses the pump actuator to produce a stream of the fluent product. Such a finger-operable dispenser is frequently used for hand soaps and sanitizers and the like. The finger-operable dispenser requires the user to manually operate the pumping structure which can cause germs to pass from the recipient to the pumping structure and vice-versa.

Some dispensers are designed for use with a pressurized container including a valve assembly and have a suitable discharge structure to dispense the fluent product under pressure. Dispensing systems comprising a valve assembly and cooperating dispenser are typically mounted at the top of the container, such as a metal can containing the pressurized product. The dispenser typically includes an external actuator that is connected to the valve assembly and that provides a dispensing passage from which the product can be dispensed to a target area. Again, such dispensing systems require manual actuation by a user such as by depressing the external actuator. This leads to the transfer of germs, as above.

Touchless dispensers for aerosol products have found use in commercial applications. These dispensers are electrically powered and are typically mounted to a wall and are hardwired to an electrical power source. Such devices are not adapted for widespread usage and typically require aerosol containers specifically designed for the overall structure.

SUMMARY OF THE INVENTION

In accordance with the invention, a unique, self-propelled dispensing system for a fluent product requires no contact for actuation. The user only needs to hold his/her hand under a discharge orifice for the system to dispense a liquid, such as lotion, hand soap, shampoo, sanitizer, etc., into the hand without the need for manually actuating the system.

There is disclosed in accordance with one embodiment of the invention a touchless dispenser for a pressurized container including a valve member. The dispenser comprises a housing mountable to the container. An electrically controlled valve in the housing includes an inlet and an outlet. The inlet maintains the valve member in an open position incident to the housing being mounted on the container. A nozzle extends between the valve outlet and a discharge orifice. A sensor senses a user's hand proximate the discharge orifice. A control in the housing is operatively coupled to the sensor and the electrically controlled valve. The control controls operation of the electrically controlled valve to dispense a select dosage of product from the container responsive to the sensor sensing presence of a user's hand proximate the discharge orifice.

There is disclosed in accordance with another embodiment of the invention a touchless dispenser for a pressurized container including a valve member. The dispenser comprises a housing mountable to the container. The housing comprises a base and a cover. The cover is removably receivable on the base to define an interior space. The base has a neck mountable to the container and first and second support structure in the interior space. An electrically controlled valve is mountable to the first support structure and has a pair of electrical leads extending therefrom. The electrically controlled valve includes an inlet and an outlet. The inlet engages and actuates the valve member (e.g., moves the valve member to an open position) incident to the base being mounted on the container. A nozzle extends between the valve outlet and a discharge orifice. A circuit board is mountable to the second support structure. The circuit board comprises battery mounting clips, a sensor for sensing proximity of a user's hand, terminal pads for engaging the valve leads, and a control circuit. The control circuit is operatively coupled to the sensor, the battery clips and the terminal pads. The control circuit controls operation of the electrically controlled valve to dispense a dosage of product from the container using battery power responsive to the sensor sensing presence of a user's hand proximate the discharge orifice.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position. Terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed description of such elements is not necessary to an understanding of the invention, and accordingly, is herein presented only to the degree necessary to facilitate an understanding of the novel features of the present invention.

Figure 1:
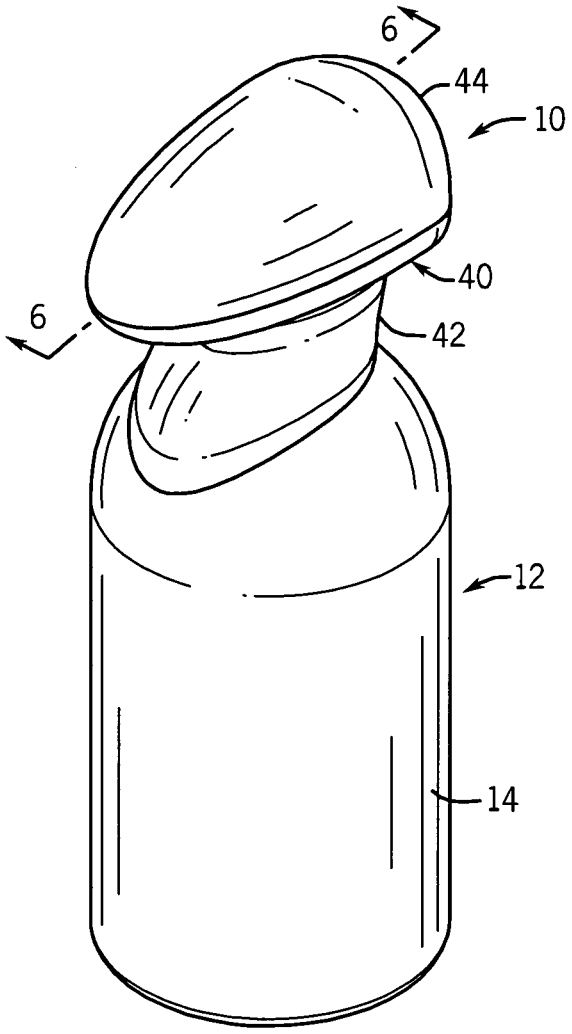
FIG. 1 is an isometric view of a dispensing system comprising a touchless dispenser in accordance with the invention mounted to a pressurized container.

FIG. 1 illustrates a dispensing system comprising a touchless dispenser 10 in accordance with the invention for use with a pressurized container 12, such as a conventional aerosol container. The touchless dispenser 10 is an electronically controlled dispenser. The pressurized container 12 is filled with a product under pressure to be dispensed. A bag-on-valve type of aerosol valve is preferred in the pressurized container 12 containing a product where it is desired to have no contact between the product and the pressurized propellant gas in the container. However, other conventional pressurized systems may be used as well. In accordance with the invention, the touchless dispenser 10 can be used with various configurations of a pressurized container. The particular pressurized container 12 shown in the drawings and described herein is by way of example only. The touchless dispenser 10 can be readily adapted, as will be apparent, in accordance with the configuration of a particular pressurized container with which it is used.

Figure 6:
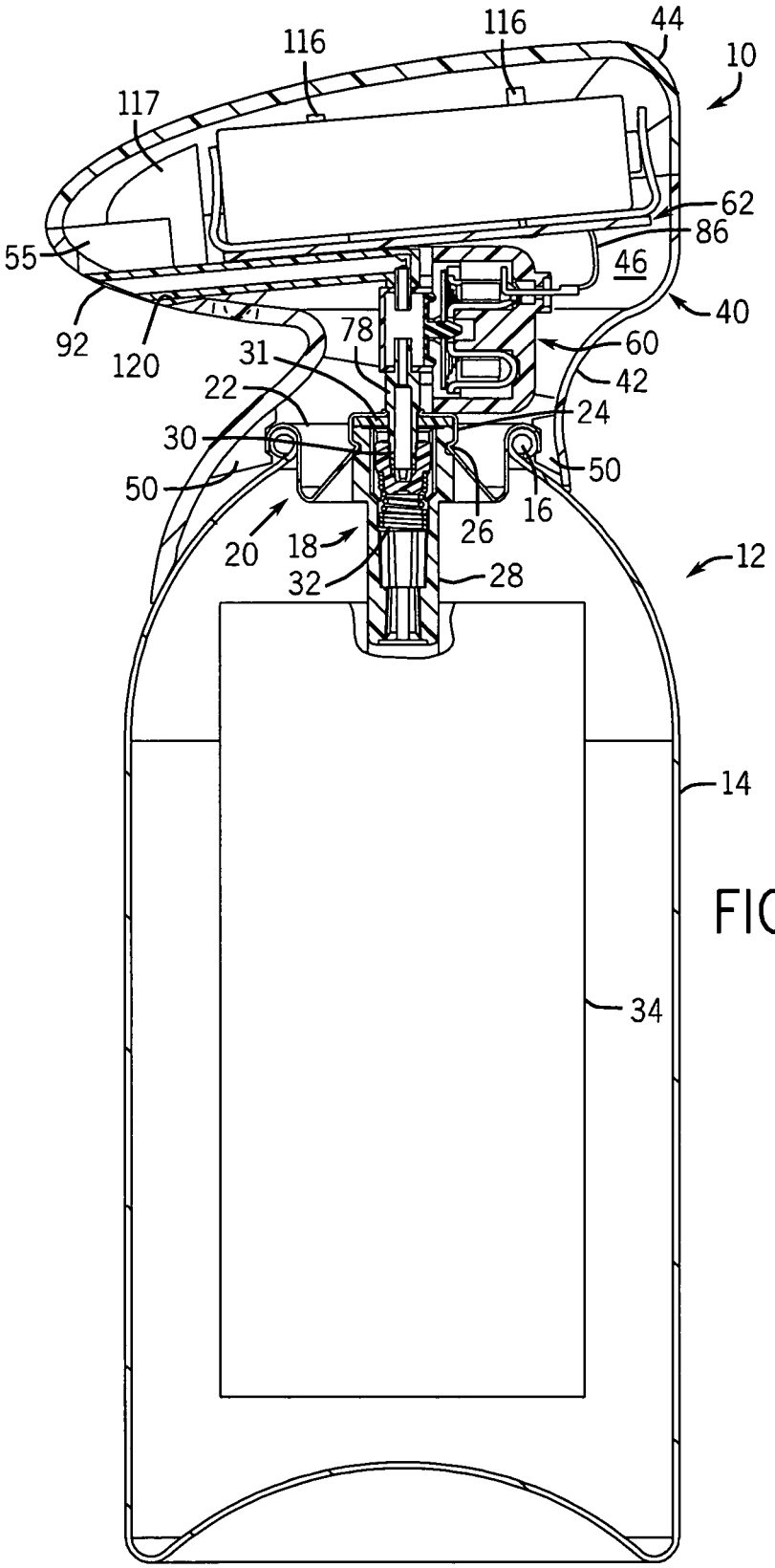
FIG. 6 is a sectional view taken along the line 6-6 of FIG. 1.

The illustrated pressurized container 12 is described particularly with reference to FIG. 6. The pressurized container 12 comprises a metal can 14 having an upper edge rolled into a mounting bead 16. A normally closed dispensing valve 18 is mounted to the metal can 14 by a conventional valve mounting cup 20. The mounting cup 20 has a mounting flange 22 crimped about the mounting bead 16 and an overlying gasket (not shown) to provide a secure attachment of the mounting cup 20 to the metal can 14.

The mounting cup 20 includes an annular wall 24 which defines an opening through which a portion of the dispensing valve 18 projects. The annular wall 24 includes a crimp 26 for engaging an inner portion of a body 28 of the dispensing valve 18. The valve body 28 houses a movable valve member in the form of a female valve piston 30. A compression spring 32 in the valve body 28 biases the valve piston 30 upwardly toward a closed position against an annular seal gasket 31. A lower end of the valve body 28 extends downwardly into the can 14 and is sealed to a pouch or bag 34 that contains the product to be dispensed.

As is conventional with pressurized dispensers of this type, the bag 34 is surrounded by a suitable pressurized propellant gas, and the product in the bag 34 is dispensed under pressure when the valve piston 30 is forced downwardly against the spring 32 so as to reposition the top of the valve piston 30 to a location spaced below the overlying seal gasket 31. Pressurized fluid product in the bag 34 can flow upwardly in vertical clearances alongside an outside cylindrical surface of the valve piston 30, then over the top of the piston 30 beneath the annular seal gasket 31, then down vertical channels (not shown) on the inside of the cavity in the upper end of the valve piston 30 to the bottom opening in a hollow tube or actuating stem 78 that is received in the piston cavity and that extends downwardly from the touchless dispenser 10 as described in more detail hereinafter. FIG. 6 illustrates the valve piston 30 in the depressed, i.e., open, position, as described below. The dispensing valve 18 may have any suitable conventional or special internal construction that provides a product discharge movable valve member biased outwardly to a closed position, and the details of such an internal construction form no part of the present invention. Also, in an alternative embodiment of the invention (not shown), the dispensing valve 18 could have a male valve piston that includes a conventional upwardly projecting valve stem extending into the touchless dispenser 10.

Figure 2:
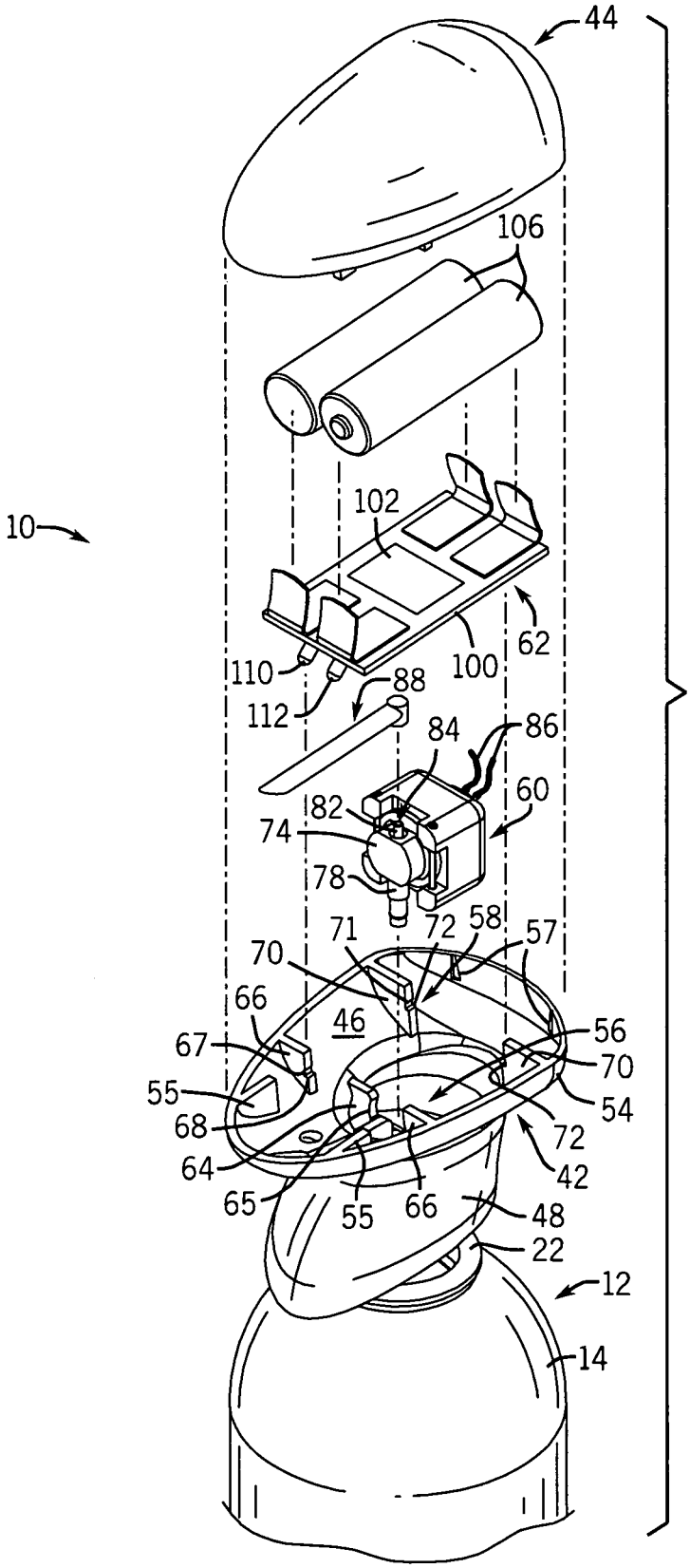
FIG. 2 is a fragmentary top, exploded isometric view of the touchless dispenser and pressurized container of FIG. 1.
Figure 3:
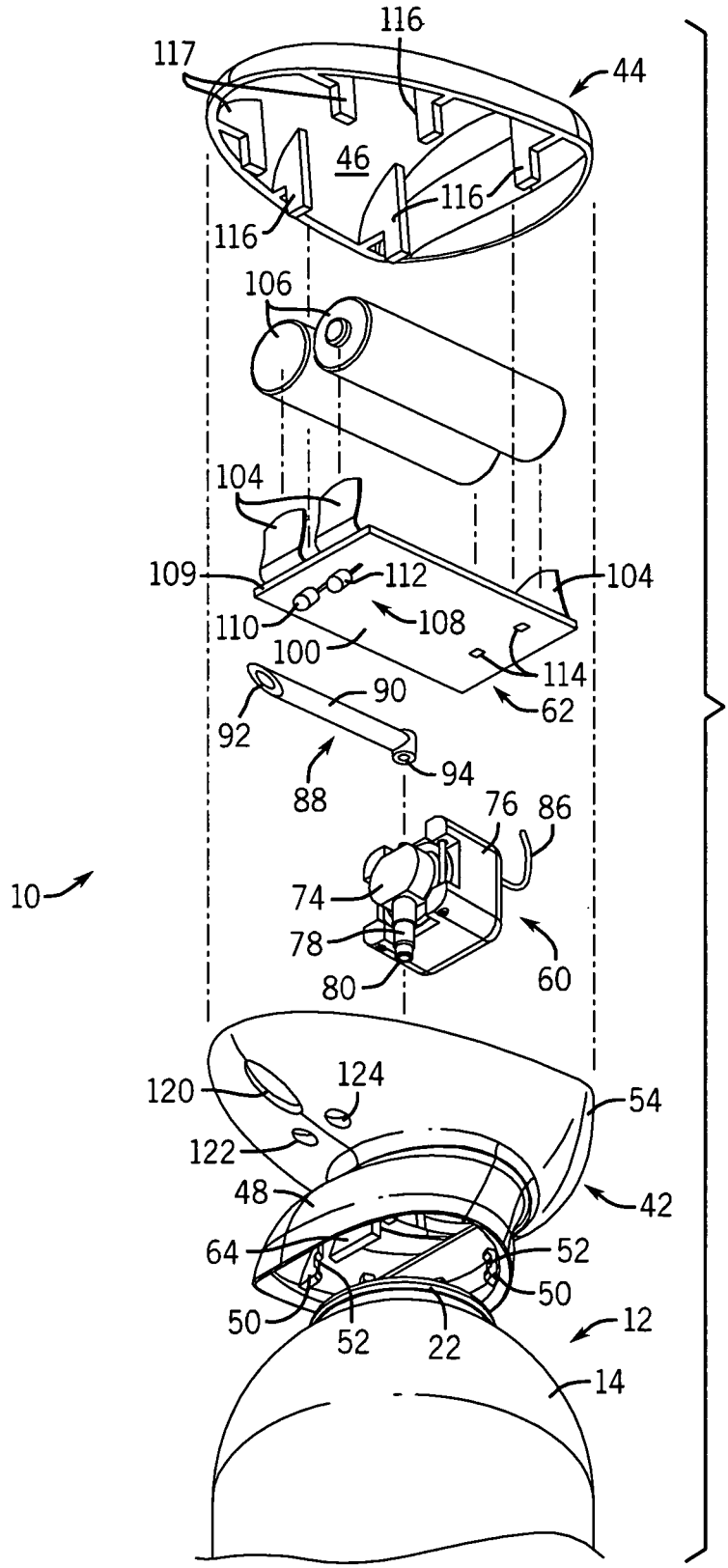
FIG. 3 is a fragmentary bottom, exploded isometric view of the touchless dispenser and pressurized container of FIG. 1.

As shown in FIG. 1, the touchless dispenser 10 comprises a housing 40 mountable to the pressurized container 12. The housing 40 comprises a base 42 and a cover 44. Referring to FIGS. 2 and 3, the cover 44 is removably receivable on the base 42 to define an interior space 46. A lower part of the base 42 comprises a neck 48 shaped and formed to sit atop the can 14. A plurality of ribs 50, see FIG. 3, extend inwardly from the neck 48 and include notches 52 for receiving the flange 22 to mount the base 42 onto the pressurized container 12 using a snap on configuration. The base 42 widens above the neck 48 at an upper head 54.

The inside of the base 42, at a top edge of the head 54, includes a pair of rearwardly extending front ribs 55 and a pair of frontwardly opening rear notches 57. The inside of the base 42 also includes first support structure 56 and second support structure 58 for supporting a solenoid valve 60 and circuit board 62, respectively. The second support structure 58 is higher than the first support structure 56. The first support structure 56 comprises opposite brackets 64 (one of which is visible in FIG. 2) extending inwardly from opposite sides of the neck 48. Each bracket 64 includes a rounded notch 65 for supporting the solenoid valve 60. The second support structure 58 comprises opposite front ribs 66, each having a notch 67 just above a shoulder 68, and opposite rear ribs 70, each having a notch 71 just above a shoulder 72, extending inwardly from the head 54. The circuit board 62 rests on the shoulders 68 and 72 between the opposite front ribs 66 and the opposite rear ribs 70, respectively, with its side edges received in the notches 67 and 71. Rear corners of the circuit board 62 are received in the notches 57, while the front ribs 55 prevent forward movement of the circuit board 62.

The solenoid valve 60 is of conventional construction and includes a cylindrical valve body 74 operated by a solenoid 76. The valve body 74 is captured in the bracket rounded notches 65. The valve body 74 contains a conventional diaphragm, not shown, that opens and closes a flow path of the product, as described below. As will be apparent, other types of electrically controlled valves could be used, such as piezo, electrostatic, or the like. The actuating stem 78 comprises a lower stem that depends downwardly from the valve body 74 and defines an inlet 80 (FIG. 3). An upper stem 82 extends upwardly from the valve body 74 and defines an outlet 84 (FIG. 2). A pair of electrical leads 86 extends upwardly from the rear of the solenoid 76. The leads 86 are of rigid construction for electrically connecting the solenoid 76 to the circuit board 62, as described below.

A nozzle 88 (FIG. 3) comprises an elongate tube 90 having an angled outlet 92 at one end and a downwardly opening inlet 94 at an opposite end. The downwardly opening inlet 94 is receivable on the valve body upper stem 82, with the elongate tube 90 extending frontward. Alternatively, the nozzle 88 may be produced as one part with the valve body upper stem 82.

The circuit board 62 includes a suitable insulating substrate 100 having electrical traces (not shown) for providing interconnection between electronic components of a control illustrated generally at 102, see FIG. 2. The various electrical components and interconnections are described below with respect to the schematic diagram of FIG. 7. The circuit board 62 includes battery clips 104 extending upwardly from the substrate 100 for supporting a pair of batteries 106. A proximity sensor 108 is secured at an underside of the substrate 100 near a front edge 109. The sensor 108 comprises a light-emitting diode, "LED", 110 and an infrared, "IR", sensor 112. As is apparent, other types of proximity sensors could be used such as capacitive, inductive, thermal, or the like. The circuit board 62 also includes a pair of terminal pads 114 in the form of female receptacles for removably receiving the solenoid valve leads 86, as described below.

In the illustrated embodiment of the invention, the solenoid valve leads 86 are removably receivable in receptacles 114 of the printed circuit board 62. Alternatively, the solenoid valve leads 86 could be hardwired to circuitry of the circuit board 62, such as by soldering or crimping. Moreover, the solenoid valve 60 could be mounted directly to the circuit board 62, as is apparent.

The cover 44 is of a shape to be received on the base head 54 and includes opposite pairs of downwardly depending side arms 116 and a pair of front arms 117. The side arms 116 frictionally engage the base ribs 66 and 70 and the front arms 117 frictionally engage the base front ribs 55 to secure the cover 44 to the base 42. Particularly, on each lateral side of the cover 44, the distance between outwardly facing surfaces of the two side arms 116 is approximately the same as the distance between inwardly facing surfaces of the base ribs 66 and 70 so that the inwardly facing surfaces of the base ribs 66 and 70 frictionally engage the outwardly facing surfaces of the two side arms 116. Similarly, the distance between outwardly facing surfaces of the front arms 117 is approximately the same as the distance between inwardly facing surfaces of the front ribs 55 so that the inwardly facing surfaces of the front ribs 55 frictionally engage the outwardly facing surfaces of the front arms 117. Alternatively, the mating edges of the cover 44 and base 42 could be stepped or have a bead and groove to secure the cover 44 to the base 42, or the cover 44 could be flexibly hinged to the base 42.

Figure 4:
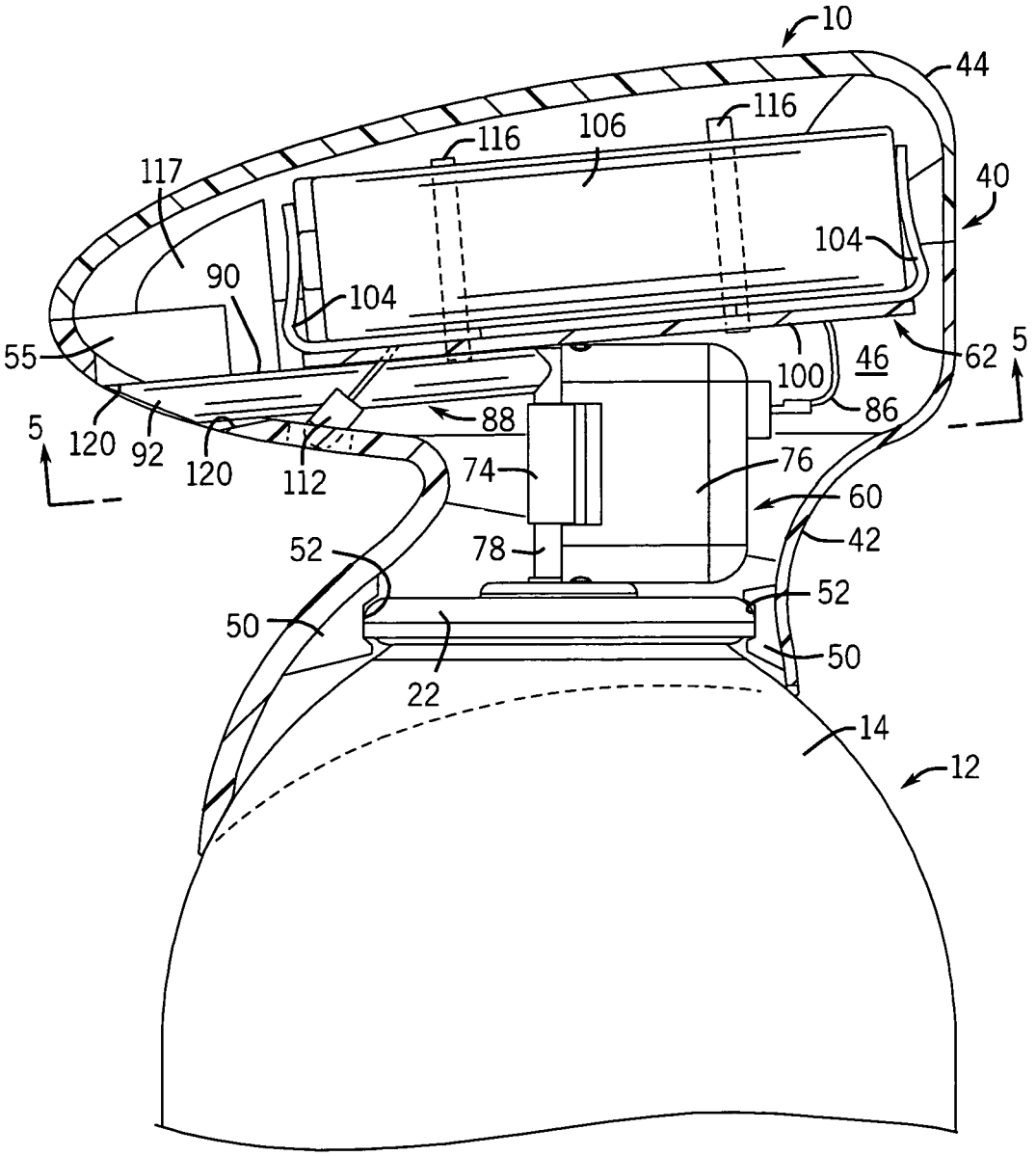
FIG. 4 is an enlarged, fragmentary side, elevation view of the touchless dispenser mounted to the pressurized container, with a housing thereof shown in cross-section.

FIGS. 4 and 6 illustrate the touchless dispenser 10 in its assembled configuration. The components can be readily assembled as will now be described. First, the solenoid valve 60 is mounted in the base 42, as described above, so that the leads 86 can subsequently "plug" into the circuit board receptacles 114 to loosely mount the solenoid valve 60 to the circuit board 62. The nozzle 88 is mounted atop the valve body 74 so that the outlet 92 extends through a discharge aperture, opening, or orifice 120 in an underside of the head 54 wherein the periphery of the orifice 120 defined by the head 54 can prevent undue movement of the outlet end of the nozzle 88, see also FIG. 3. Next, the circuit board 62 is also mounted in the base 42, as described above, on the shoulders 68 of the front ribs 66 of the second support structure 58 and on the shoulders 72 of the rear ribs 70 of the second support structure 58, so that it is secured in place above the solenoid valve 60. The bottom surface of the mounted circuit board 62 engages the top of the nozzle tube 90 to help retain the nozzle 88 in place. Incident to the circuit board 62 being mounted in the base 42, the solenoid electrical leads 86 are plugged into, and thus make electrical contact with, the receptacles 114, as particularly illustrated in FIG. 5. The LED 110 and IR sensor 112 extend downwardly from the circuit board 62 on either side of the nozzle 88 and extend through sensor openings 122 and 124, respectively, see FIG. 3, in the head 54 proximate to and on either side of the discharge orifice 120. As such, the sensor 108 can sense a user's hand proximate the discharge orifice 120, as described below. The cover 44 is then suitably mounted to the base 42 as discussed above.

The assembled touchless dispenser 10 is mounted to the pressurized container 12 by aligning the solenoid valve lower stem 78 with the container dispensing valve piston 30 and forcing the touchless dispenser 10 downwardly until the notches 52 receive the mounting flange 22, as shown in FIG. 4. Incident to the touchless dispenser 10 being mounted to the pressurized container 12, the valve lower stem 78, defining the inlet 80, forces the container dispensing valve piston 30 downwardly and maintains the valve piston 30 depressed in the open position, as shown. Thereafter, the valve piston 30 remains open and the solenoid valve 60 becomes the primary valve. The solenoid 76 is selectively energized to control the diaphragm in the valve body 74, as is known, for moving the diaphragm from a deenergized, normally closed position, to an energized, open position, so that the pressurized contents of the container bag 34 can be dispensed upwardly through the valve body 74 into the nozzle 88 to be discharged out the discharge orifice 120.

As will be apparent, the various internal components of the touchless dispenser 10 can be of uniform size, with the size and/or shape of the neck 48 being adapted to the particular size and shape of the pressurized container 12 with which it will be used. The invention is not limited to any particular size or shape. For example, the housing base 42 could include a threaded ring for mounting to a threaded neck provided on the pressurized container, or could use a bayonet mount for engaging a pressurized container having a mating configuration.

Figure 7:
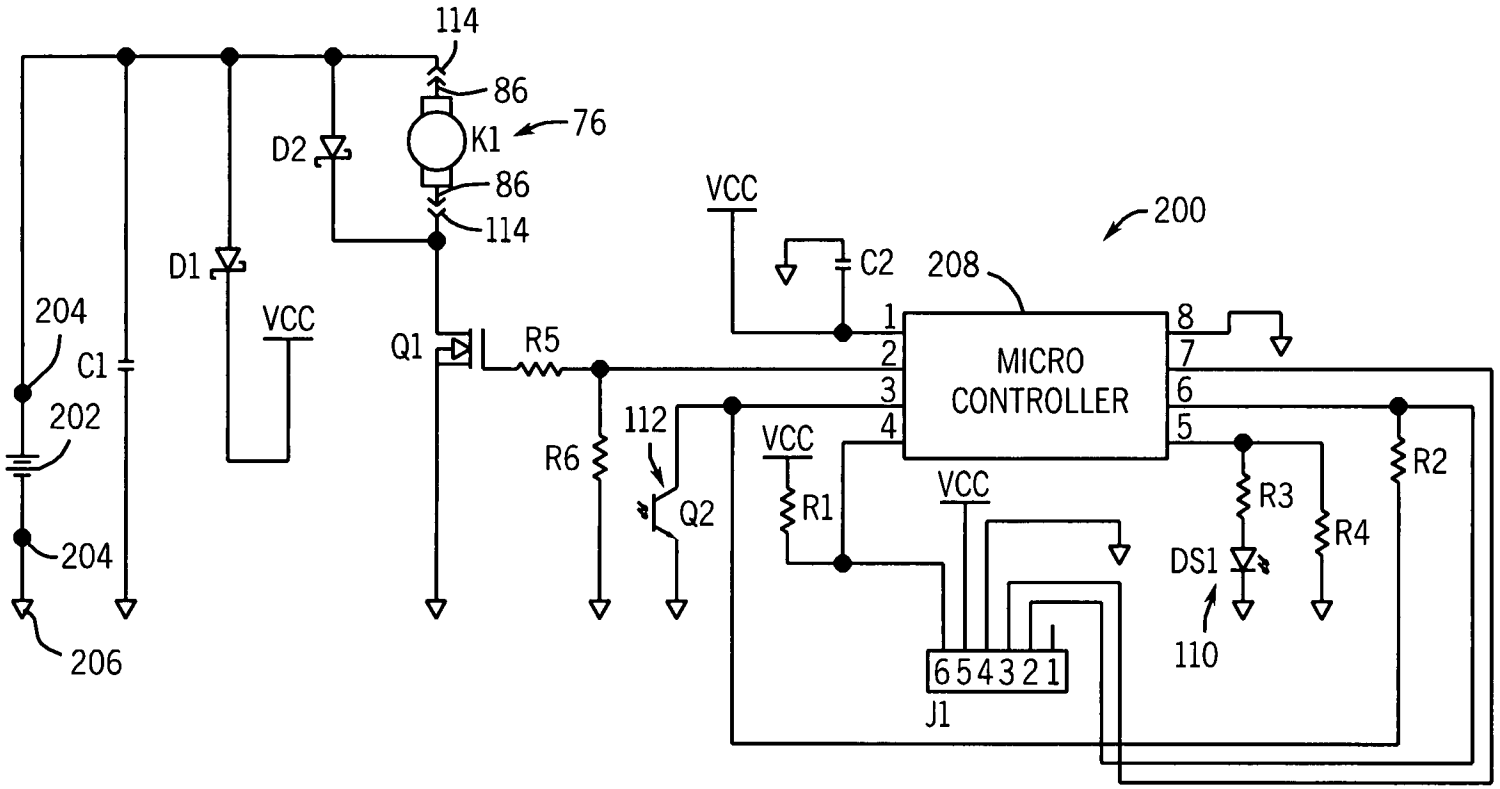
FIG. 7 is a schematic diagram of an electrical circuit for the touchless dispenser of FIG. 1 and including a programmed microcontroller.

Referring to FIG. 7, a schematic diagram illustrates a control circuit 200 for the control 102, see FIG. 2, embodied on the circuit board 62, discussed above, for controlling operation of the touchless dispenser 10. The batteries 106 are schematically represented as a voltage source 202 connected via nodes 204, corresponding to the battery clips 104, discussed above. Ground is illustrated throughout with the triangular node 206. A capacitor C1 is connected across the voltage source 202. A diode D1 is connected to a high side of the voltage source 202 to define a supply node VCC for supplying power to the control circuit 200. The solenoid 76 includes a coil K1 connected via the leads 86 to the terminals 114. A diode D2 is connected across the coil K1 between the high side of the voltage source 202 and a switching FET transistor Q1. The gate of the transistor Q1 is connected via a resistor R5 to pin 2 of a microcontroller 208. A resistor R6 is connected between pin 2 and ground.

In the illustrated embodiment of the invention, the microcontroller 208 comprises a PIC12F683 8-pin, flash-based, 8-bit CMOS microcontroller. The microcontroller 208 includes a microprocessor and associated memory and operates in accordance with a control program stored in the memory for controlling operation of the various output devices based on inputs and control parameters, as described below with respect to the flow diagram of FIG. 8.

As is apparent, other types of microcontrollers, microprocessors and memories, logic control circuits, or the like could be used as will be apparent to those skilled in the art.

Pin 1 of the microcontroller 208 is connected to the supply VCC and via a capacitor C2 to ground. Pin 8 is connected to ground. Pin 3 is connected to a phototransistor Q2 comprising the infrared sensor 112, see FIG. 5. Pin 3 is also connected via a resistor R2 to pin 6. The phototransistor Q2 may be a type PT204-6B phototransistor. Pin 4 is connected via a resistor R1 to the supply node VCC. Pin 5 is connected via a resistor R4 to ground. A series combination of a resistor R3 and an infrared emitting diode DS1, comprising the LED 110, is connected across the resistor R4. Pins 4, 6 and 7 are connected to a jumper block J1. The jumper block J1 can be used for programming or testing.

Figure 5:
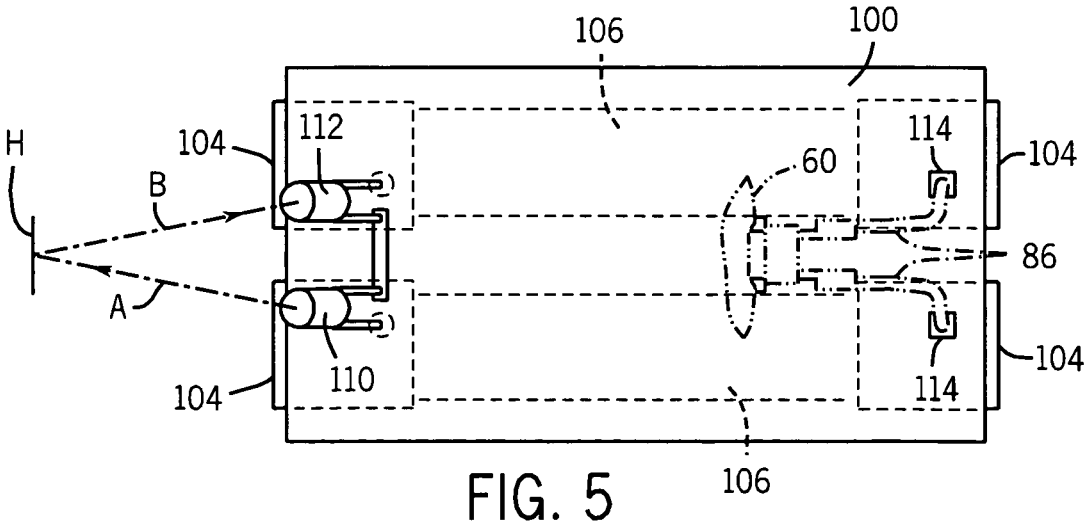
FIG. 5 is a fragmentary, partially sectional view taken along the line 5-5 of FIG. 4, with the housing omitted to reveal interior details.

With the control circuit 200 of FIG. 7, the microcontroller 208 periodically flashes the LED 110 to emit a light beam A as shown in FIG. 5. If a hand, represented by H, is present, the light beam A is reflected, and the reflected light beam B is sensed by the IR sensor 112, and sensed by the microcontroller 208. The microcontroller 208 controls operation of the solenoid coil K1 to dispense a select dosage of product from the pressurized container 12 responsive to the sensor 108 sensing presence of a user's hand proximate the discharge orifice 120.

Although not shown, the control circuit 200 could include an on/off switch or be supplied without batteries or with a removable insulating strip placed between the batteries 106 and the battery clips 104 to prevent operation when not in use.

Figure 8:
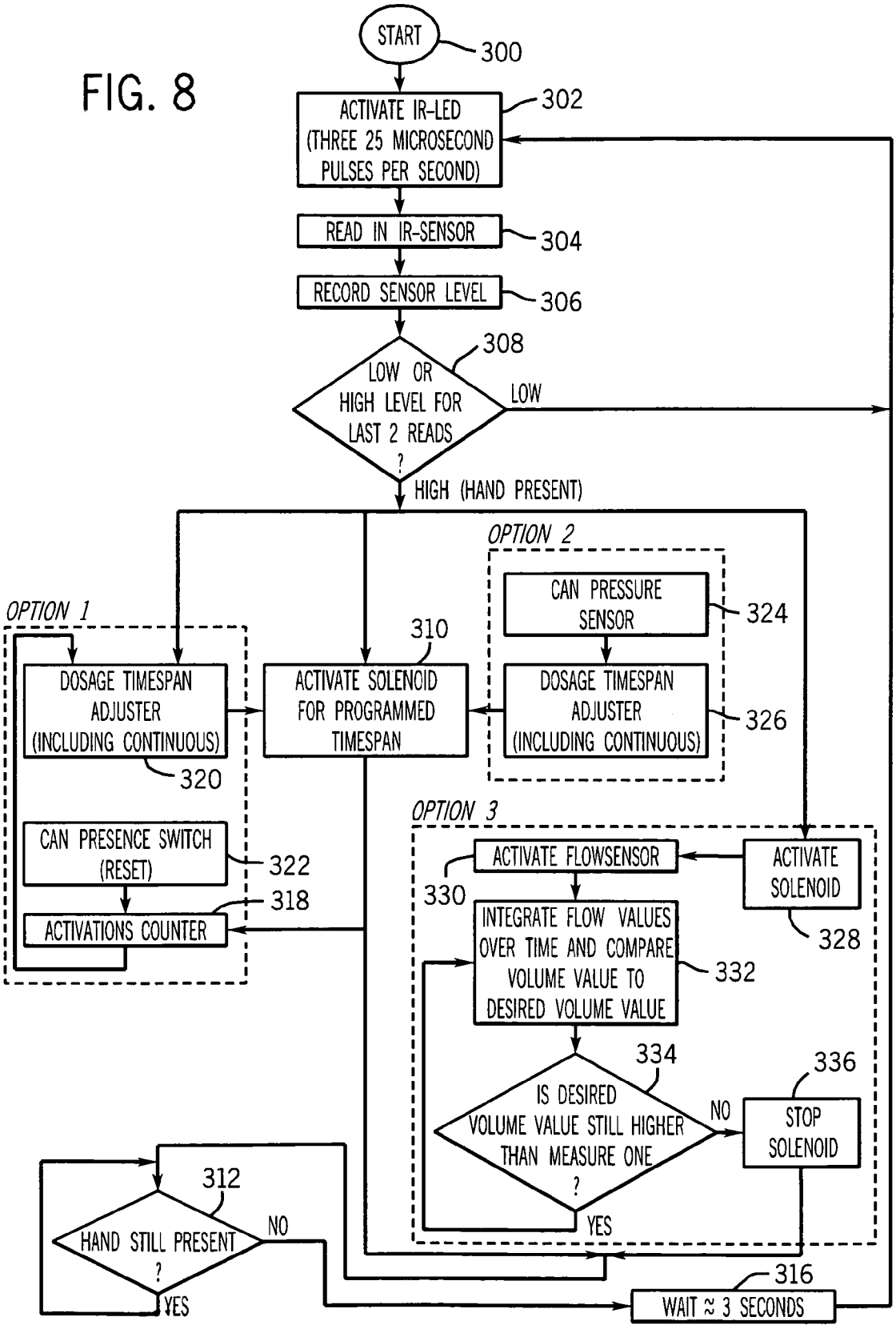
FIG. 8 is a flow diagram illustrating operation of a control program implemented by the microcontroller of FIG. 7.

The flow diagram of FIG. 8 illustrates a control program implemented by the microcontroller 208. The program begins at a start node 300 when the control circuit 200 is energized, such as when any power switch is in an ON position or the batteries are properly inserted, i.e., with any removable insulating strip out. Thereafter, the program continuously operates. The program advances to a block 302 which periodically activates the LED 110. In the illustrated embodiment of the invention, three twenty-five microsecond pulses are provided per second to preserve battery life. The program reads the IR sensor 112 at a block 304. The sensor level is recorded at a block 306. A decision block 308 then determines if the recorded sensor level is low or has been high for the last two reads. In accordance with the invention, the program avoids dispensing a dosage absent a user placing the hand proximate the sensor 108 for a specified length of time, corresponding to two reads. This avoids a dosage being dispensed if, for example, a fly or the like passes by the sensor, or if a user's hand passes nearby but does not remain. If the reading is low, or not high for two consecutive reads, then the program returns to the block 302 for a subsequent reading.

If the sensed level is high for two consecutive reads, as determined at the decision block 308, then the program proceeds to a block 310 which activates the solenoid coil K1 for a programmed select timespan to move the solenoid valve diaphragm to the open position whereby the pressurized product flows through the solenoid valve 60 and out of the dispenser 10. In accordance with the invention, the timespan comprises a select time corresponding to dispensing a select dosage of product from the pressurized container 12. The solenoid valve 60 is open for a time period controlled by the program. The dosage, and thus the select timespan used, will be different for different products, and thus the timespan is programmable.

After the solenoid coil K1 has been activated at the block 310, a decision block 312 determines if a hand is still present. If a user's hand is still present, then the program loops around the block 312 until the user's hand is removed from proximate the discharge orifice 120. If the user's hand is not still present, then the program waits three seconds at a block 316 and then returns to the block 302. This wait will interrupt dispensing for three seconds. As such, the user's hand must be removed from proximate the discharge orifice 120 for more than three seconds before the dispenser 10 will dispense another dose. As is apparent, the three second wait time could be a different value.

Advantageously, the select dosage amount is uniform. Accordingly, the solenoid valve open time may be varied depending on, among other factors, the viscosity of the product, remaining pressure, and the desired dosage. Bag-on-valve products lose pressure during use throughout the life of the package (comprising the pressurized container 12 and product). This will affect dosage. To compensate for this, the solenoid valve open time can be varied to match the pressure drop through the life of the package. This can be done knowing the starting and ending pressures, viscosity of the product, volume of the package, and the desired dose. In accordance with a first option, a block 318 counts the actuations of the solenoid 76, from the block 310, and sends a count value to a dosage timespan adjuster block 320. The dosage time span adjuster block 320 comprises a lookup table or formula which increases the timespan value in response to decreasing pressure, represented by the count value, to provide uniform doses. The dosage time span adjuster block 320 receives an indication from the block 308 that the solenoid 76 is to be activated and transfers the select timespan value corresponding to the remaining pressure and desired dosage to the block 310. As a result, the select dosage dispensed remains uniform throughout the life of the package. The activations counter 318 can be reset responsive to a can presence switch being activated at a block 322 such as when the touchless dispenser 10 is to be mounted to a new aerosol container 12. The can presence switch is not shown in the control circuit of FIG. 7. It could be implemented in software.

Rather than relying on a count value, a second option, using a second adjuster block 326, reads actual pressure directly from a can pressure sensor 324. The can pressure sensor 324 will sense pressure in the can and provide a corresponding input to the microcontroller 208, as will be apparent. The dosage time span adjuster block 326 increases the timespan value in response to decreasing pressure to provide uniform doses.

A third option measures flow rate when the solenoid valve 60 is open using a flow sensor (not shown), which would be input to the microcontroller 208, and adjust the valve open time accordingly. Particularly, a block 328 activates the solenoid coil K1. A block 330 activates the flow sensor. A block 332 integrates flow rate values over time, to determine the volume amount dosed, and compares the volume amount to a desired volume value. A decision block 334 determines if the desired volume value is higher than the measured value. If so, then the program loops back to the block 332. If not, indicating that the desired dosage has been dispensed, then the program advances to a block 336 which stops the activation signal to the solenoid coil K1. The program then advances to the block 312, discussed above.

Alternatively, a continuous stream of product could be provided as long as the sensor 108 senses the presence of the user's hand. In this embodiment, the user controls the amount of product dispensed. This can be implemented by selecting the timespan at the block 320 to be dependent on presence of a user's hand rather than time.

The touchless dispenser 10 is formed of relatively few components comprising the housing 40, the solenoid valve 60, with the nozzle 88, the circuit board 62 and two AA batteries 106. A single AA or possibly a AAA battery may be sufficient to power the system through one entire package use. With a one battery system, the user would replace the battery when the user replaces the empty can 14. The changing of the battery could also be used to reset the activations counter, as discussed above, at the block 322.

All of the electronic components are snapped into the housing 40 which holds them in place without requiring the user to manipulate separate fasteners. The housing 40 has a snap-on type fitment for easy removal from the aerosol can. Alternatively, a screw type mount or bayonet type mount could be used, as described.

When the touchless dispenser 10 is fully assembled, it can be installed to operate as a dispensing system with the pressurized container 12, as follows. The can 14 is filled with product and pressurized, in the illustrated embodiment using a bag-on-valve valve, with 40-150 PSI of a compressed gas around the bag 34 in the can 14. When the touchless dispenser 10 is attached to the mounting flange 22, the solenoid valve lower stem 78 protrudes from the bottom of the valve body 74 and actuates the container dispensing valve piston 30 to maintain the dispensing valve 18 fully open during the life of the can 14 (i.e., until the entire product is dispensed from the can by the user). With the container dispensing valve 18 being maintained continuously open, the solenoid valve 60 then becomes the primary valving system. As previously described, the solenoid valve 60 contains an internal diaphragm that opens and closes the flow path of the product from the pressurized container 12 to the discharge orifice 120. The solenoid valve 60 is activated by the sensor 108 sensing the presence of a user's hand proximate the discharge orifice 120. When the sensor 108 is activated, the microcontroller 208 sends a signal to open the solenoid valve 60 for a select period of time and the product is dispensed into the user's hand. The user's hand must be removed from proximate the discharge orifice 120 and placed back into proximity with the discharge orifice 120 for another dosage of product. The system could be programmed for the user to control the amount dispensed by the user's hand being moved away when enough product is present.

With the touchless dispenser 10 as described, a user does not need to touch the dispenser for product to be dispensed. As such, no germs are passed to or from the user. A dosage of product is dispensed to the user without the user having to contact the touchless dispenser 10. All of the components in the touchless dispenser 10 fit inside of the housing 40 which fits on a standard pressurized container 12. The touchless dispenser 10 is battery operated for portability and use anywhere. No user wiring is required. The cover 44 can be readily removed by a user when necessary to install a new battery or batteries 106, and the user can easily mount the cover 44 back onto the base 42. Moreover, the touchless dispenser 10 can be easily removed from the pressurized container 12 so that a refill can may be substituted. As such, the touchless dispenser 10 is environmentally friendly. Moreover, assembly of the touchless dispenser 10 may be done by hand or automation. The system is designed for all of the parts to be assembled on a center axis. All connections are made directly to accommodate the use of a fully automated assembly process without the requirement of any wiring connections being made manually as the connections are automatically made between the solenoid valve 60 and the circuit board 62, as described. In an alternate embodiment, the solenoid valve 60 may be directly mounted to the circuit board 62 as a subassembly, and the subassembly is mounted in the housing base as a single unit. In this alternate embodiment, the solenoid valve 60 and circuit board 62 are otherwise supported and maintained in the housing using the support structure 56 and 58 described above.

The present invention has been described with respect to flowcharts and block diagrams. It will be understood that each block of the flowchart and block diagrams can be implemented by computer program instructions. These program instructions may be provided to a processor to produce a machine, such that the instructions which execute on the processor create means for implementing the functions specified in the blocks. The computer program instructions may be executed by a processor to cause a series of operational steps to be performed by the processor to produce a computer implemented process such that the instructions which execute on the processor provide steps for implementing the functions specified in the blocks. Accordingly, the illustrations support combinations of means for performing a specified function and combinations of steps for performing the specified functions. It will also be understood that each block and combination of blocks can be implemented by special purpose hardware-based systems which perform the specified functions or steps, or combinations of special purpose hardware and computer instructions.

Thus, in accordance with the invention, there is provided a self-propelled dispensing system of viscous product that requires no contact for actuation, and that can be incorporated in a hand-held, portable package which can be resupplied with product when necessary.

It will be readily apparent from the foregoing detailed description of the invention and from the illustrations thereof that numerous variations and modification may be effected without departing from the true spirit and scope of the novel concepts or principles of this invention.

What is claimed is:

1. A touchless dispenser for a pressurized container including a valve member, comprising:

a housing mountable to the container, the housing comprising a base and a cover, the base defining an interior space and the cover being removably receivable on the base to enclose the interior space, the base having a neck mountable to the container and first and second support structure in the interior space;

an electrically controlled valve mountable to the first support structure and having a pair of electrical leads extending therefrom, the electrically controlled valve including an inlet and an outlet, the inlet actuating the valve member to an open position incident to the base being mounted on the container;

a nozzle extending between the valve outlet and a discharge orifice;

a circuit board mountable to the second support structure and comprising battery mounting clips mounted to the circuit board, a sensor mounted to the circuit board for sensing proximity of a user's hand, terminal pads for electrically engaging the valve electrical leads, and a control circuit operatively coupled to the sensor, the battery clips and the terminal pads, the control circuit controlling operation of the electrically controlled valve to dispense a dosage of product from the container using battery power responsive to the sensor sensing presence of a user's hand proximate the discharge orifice.

2. The touchless dispenser of claim 1 wherein the base comprises a first sensor opening proximate the discharge orifice, and the sensor comprises an infrared sensor positioned at the first sensor opening.

3. The touchless dispenser of claim 1 wherein the terminal pads engage the valve electrical leads incident to the circuit board and electrically controlled valve being mounted in the base.

4. The touchless dispenser of claim 3 wherein the valve electrical leads extend upwardly incident to the electrically controlled valve being mounted to the first support structure and the terminal pads are located on a bottom surface of the circuit board.

5. The touchless dispenser of claim 3 wherein the terminal pads comprise contact receptacles, and the electrical leads plug into the contact receptacles.

6. The touchless dispenser of claim 3 wherein the base comprises a second sensor opening proximate the discharge orifice, and the sensor further comprises an LED positioned at the second sensor opening.

7. The touchless dispenser of claim 6 wherein the control circuit periodically activates the LED.

* * * * *